US010600562B2

(12) United States Patent
Lin et al.

(10) Patent No.: US 10,600,562 B2
(45) Date of Patent: Mar. 24, 2020

(54) MANUFACTURING METHOD OF MAGNETIC ELEMENT

(71) Applicant: FSP TECHNOLOGY INC., Taoyuan (TW)

(72) Inventors: Kuo-Fan Lin, Taoyuan (TW); Fu-Kai Tu, Taoyuan (TW)

(73) Assignee: FSP TECHNOLOGY INC., Taoyuan (TW)

( * ) Notice: Subject to any disclaimer, the term of this patent is extended or adjusted under 35 U.S.C. 154(b) by 322 days.

(21) Appl. No.: 15/464,269

(22) Filed: Mar. 20, 2017

(65) Prior Publication Data

US 2017/0287631 A1 Oct. 5, 2017

Related U.S. Application Data

(60) Provisional application No. 62/315,677, filed on Mar. 31, 2016.

(30) Foreign Application Priority Data

Oct. 13, 2016 (TW) ..... 105132961

(51) Int. Cl.
*H01F 27/34* (2006.01)
*H01F 3/14* (2006.01)
*H01F 17/04* (2006.01)

(52) U.S. Cl.
CPC ..... *H01F 27/346* (2013.01); *H01F 3/14* (2013.01); *H01F 17/043* (2013.01); *H01F 2017/046* (2013.01)

(58) Field of Classification Search
CPC ..... H01F 41/0246; H01F 41/0206; H01F 41/0253; H01F 41/0266; H01F 27/346; H01F 3/14
See application file for complete search history.

(56) References Cited

U.S. PATENT DOCUMENTS 3,947,794 A * 3/1976 Newcomb ..... H01F 3/14 335/217
4,409,523 A * 10/1983 Yasumura ..... H01F 3/14 315/371
5,523,673 A * 6/1996 Ratliff ..... G05F 1/325 323/206
7,142,081 B1 * 11/2006 Shudarek ..... H01F 27/24 336/178
7,598,839 B1 * 10/2009 Wedley ..... H01F 3/12 336/131

(Continued)

*Primary Examiner* — Peter Dungba Vo
*Assistant Examiner* — Jeffrey T Carley

(57) ABSTRACT

A manufacturing method of a magnetic element includes the following steps: forming a block including a central post and at least one lateral post with magneto-conductive materials; cutting the block along a first plane passing through the central and lateral posts to form a first half body and a second half body; combining the first half body with the second half body to form a first air gap between the central post of the first half body and the central post of the second half body and a second air gap between the lateral post of the first half body and the lateral post of the second half body; and cutting or grinding the combined first half body and second half body along a second plane passing through the central post and the lateral post to form a third half body including the first and second air gaps.

17 Claims, 10 Drawing Sheets

(56) References Cited

U.S. PATENT DOCUMENTS

| | | | | |
|---|---|---|---|---|
| 2002/0093409 | A1* | 7/2002 | Fujiwara | H01F 1/0558 336/178 |
| 2004/0095221 | A1* | 5/2004 | Sigl | H01F 3/14 336/198 |
| 2005/0104703 | A1* | 5/2005 | Watanabe | H01F 3/14 336/83 |
| 2006/0192646 | A1* | 8/2006 | Hanley | H01F 17/06 336/200 |
| 2010/0013587 | A1* | 1/2010 | Yan | H01F 17/04 336/192 |
| 2013/0176093 | A1* | 7/2013 | Summer | H01F 3/14 336/73 |
| 2015/0102882 | A1* | 4/2015 | Shudarek | H01F 37/00 336/10 |
| 2015/0371773 | A1* | 12/2015 | Hsieh | H01F 41/0233 156/250 |

* cited by examiner

MANUFACTURING METHOD OF MAGNETIC ELEMENT

FIELD OF THE INVENTION

The present invention relates to a manufacturing method of a magnetic element, and more particularly to a manufacturing method of a magnetic element forming a plurality of air gaps on a magnetic path thereof.

BACKGROUND OF THE INVENTION

Referring to FIGS. 1A and 1B, conventional magnetic elements, such as transformers or inductance elements, include a first magnetic core 11 and a second magnetic core 12. The first magnetic core 11 has a central post 111, and the second magnetic core has a central post 121. A single air gap 14 is formed between the central post 111 and the central post 121 to prevent magnetic saturation. However, when such a single air gap 14 is larger, higher magnetic leakage may occur and thus increase energy loss. In addition, a winding 13 is fixed between the first magnetic core 11 and the second magnetic core 12 through a winding frame 10. The winding frame 10 occupies a considerable space and thus reduces the total number of windings between the first magnetic core 11 and the second magnetic core 12 so that utilization ratio of the winding and working efficiency of the magnetic element are reduced. Another conventional magnetic element includes several air gaps formed on a central post is seen in the market. The multiple air gaps can reduce and disperse magnetic leakage loss and therefore decrease magnetic flux diffusion. However, the central post limits the amount and distribution of the air gaps. When the number of the air gaps in the central post is increased, a distance between two adjacent air gaps is reduced. When the distance between two adjacent air gaps is less than a critical value, the magnetic flux diffusion cannot be further effectively reduced, and the improvement for the working efficiency is therefore limited.

SUMMARY OF THE INVENTION

The present invention provides a manufacturing method of a magnetic element including a central post and a lateral post connected to the central post, and a plurality of air gaps are formed in the central post and the lateral post. The air gaps are uniformly distributed in a magnetic path formed in the central post and the lateral post rather than concentrated in the central post, which further effectively reduces the magnetic flux diffusion and also prevents magnetic saturation and controls magnetic leakage loss in a desired range.

An embodiment of the manufacturing method of the present invention includes the following steps: forming a block including a central post and two lateral posts with magneto-conductive materials; cutting the block along a first plane passing through the central post and the lateral posts to form a first half body and a second half body; combining the first half body with the second half body to form a first air gap between the central post of the first half body and the central post of the second half body and a second air gap between the lateral post of the first half body and the lateral post of the second half body; and cutting or grinding the combined first half body and second half body along a second plane passing through the central post and the lateral post to form a third half body including the first air gap and the second air gaps.

In another embodiment, the block includes a first connecting portion connecting the central post and the lateral post and a second connecting portion connecting the central post and the lateral post, the first half body includes the first connecting portion, and the second half body includes the second connecting portion.

In another embodiment, the step of cutting or grinding the combined first half body and second half body along the second plane further includes: cutting or grinding the first connecting portion of the first half body.

In another embodiment, a thickness of the first connecting portion is smaller than a thickness of the second connecting portion.

In another embodiment, the thickness of the first connecting portion is greater than or equal to 2 mm and smaller than or equal to 5 mm.

In another embodiment, the step of combining the first half body with the second half body further includes: forming a gap between the first half body and the second half body; and filling and sintering an adhesive in the gap.

In another embodiment, the adhesive is a Bond-Ply material.

In another embodiment, the manufacturing method of the present invention further includes: placing a winding between the third half body and another third half body and around the central posts; and combining the third half body and the other third half body.

In another embodiment, the step of combining the third half body and the other third half body further includes: forming a gap between one of the third half body and other of the third half body; forming a third air gap between the central post of the third half body and the central post of the other third half body; and forming a fourth air gap between the lateral post of the third half body and the lateral post of the other third half body.

In another embodiment, the winding includes coils winded by electro-conductive flat wires.

In another embodiment, the manufacturing method of the invention further includes: fixing an isolating member to the lateral posts and maintaining a predetermined distance between the isolating member and the lateral post.

In another embodiment, the isolating member is made of magneto-conductive materials.

In another embodiment, the isolating member covers the second air gap completely.

In another embodiment, the block is formed by sintering magneto-conductive metal powder.

In another embodiment, the magneto-conductive metal powder includes manganese-zinc alloy powder.

In another embodiment, the block is cut by a diamond wire or a diamond wheel along the first plane to form the first half body and the second half body.

In another embodiment, the combined first half body and second half body are cut by a diamond wire or a diamond wheel along the second plane to form the third half body.

Since the magnetic element manufactured by the manufacturing method of the present invention includes several air gaps formed in the central post and the lateral posts and distributed uniformly on the entire magnetic path, such a structure prevents magnetic saturation and controls the magnetic leakage loss in a desired range. In addition, the magnetic element of the present invention further includes the isolating member disposed externally to the lateral posts to conduct the leaked magnetic flux back to the isolating member so as to reduce magnetic leakage and loss. In addition, since the winding of the magnetic element of the present invention is directly disposed on the central post without a winding frame, the number of windings is thus increased so as to improve utilization ratio of the winding and working efficiency of the magnetic element.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
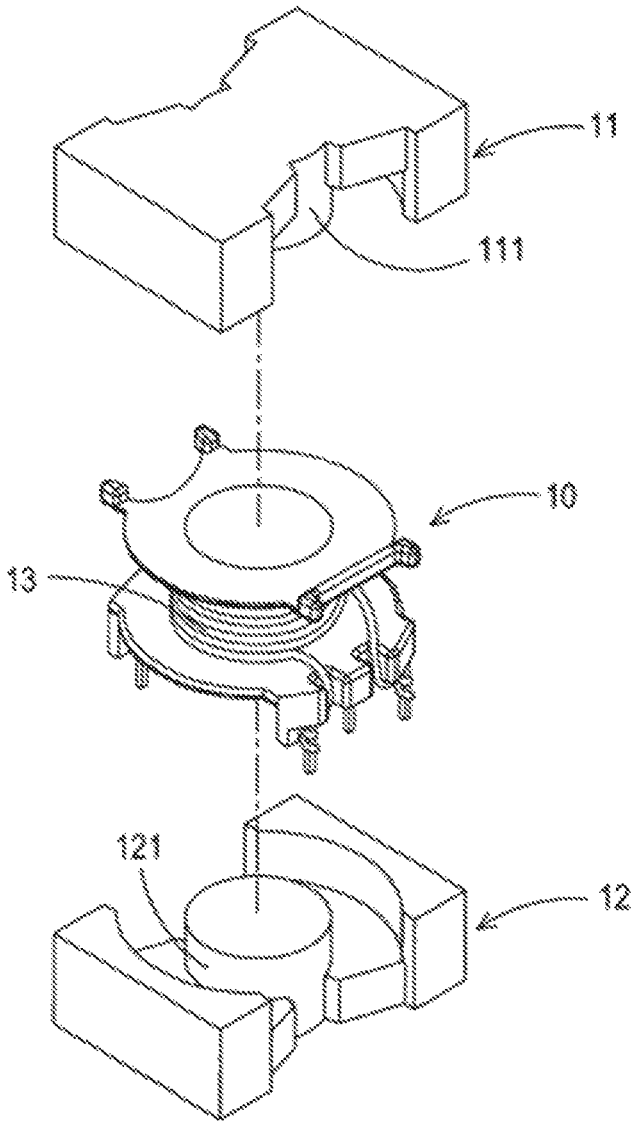
FIG. 1A (prior art)
FIG. 1A is a perspective exploded view of a conventional inductance element.
Figure 1B:
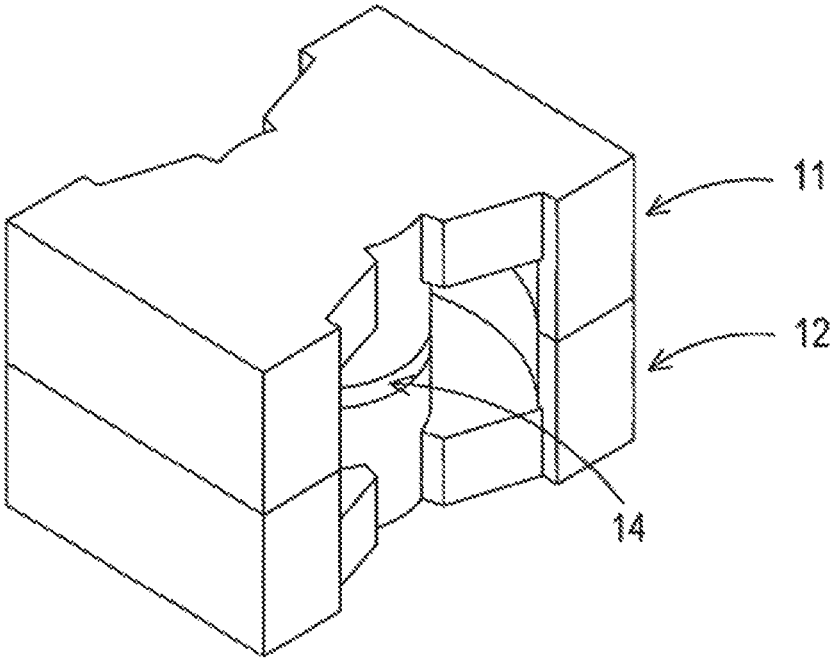
FIG. 1B (prior art)
FIG. 1B is a perspective view of a magnetic core of a conventional inductance element.
Figure 2:
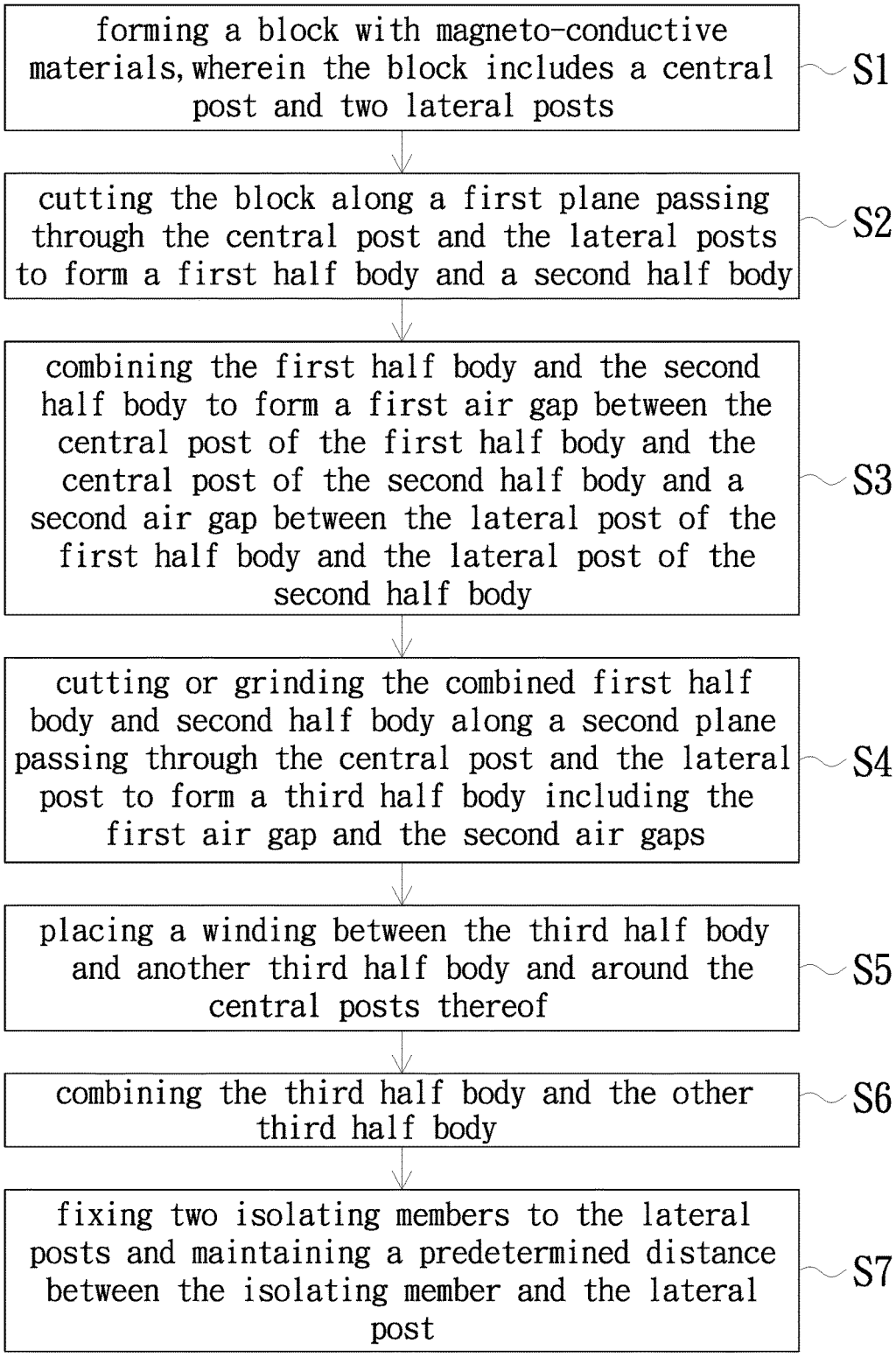
FIG. 2 is a flow chart of an embodiment of a manufacturing method of a magnetic element of the present invention.
Figure 3:
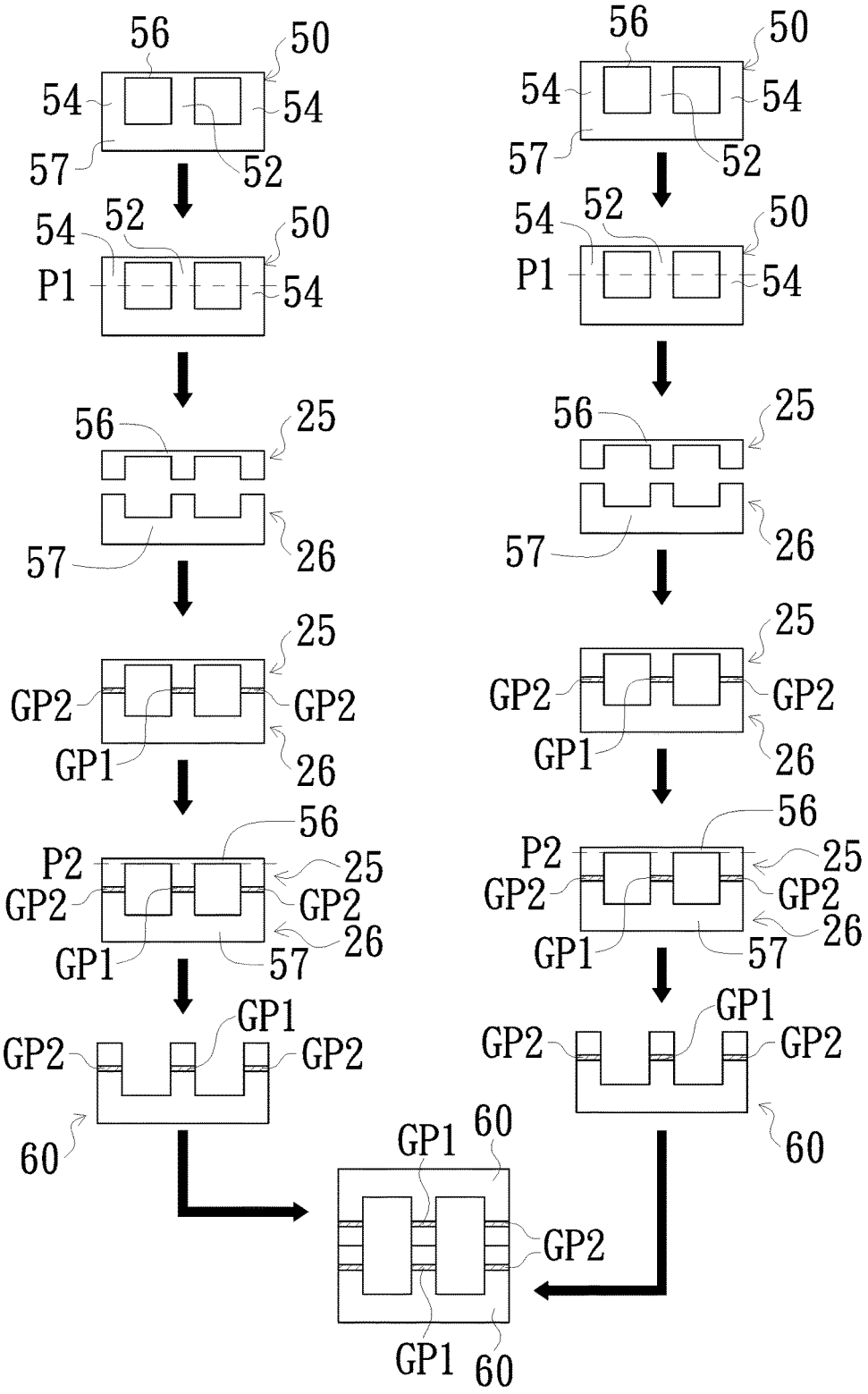
FIG. 3 is a schematic view of the manufacturing method of FIG. 2.

FIG. 2 is a flow chart of an embodiment of a manufacturing method of a magnetic element of the present invention, and FIG. 3 is a schematic view of the manufacturing method of FIG. 2. Referring to FIGS. 2 and 3, in a step S1, magneto-conductive metal powder is sintered in a mold at 100° C. to form a block 50. In this embodiment, the magneto-conductive metal powder is manganese-zinc alloy powder. The block 50 includes a central post 52, two lateral posts 54, a first connecting portion 56 and a second connecting portion 57. The first connecting portion 56 and the second connecting portion 57 are at two opposite ends of the block 50 and connect the central post 52 and the lateral posts 54 at the two ends respectively. The central post 52 is formed in a central portion of the block 50, and the lateral posts 54 are formed on two lateral sides of the blocks 50. Because the first connecting portion 56 is to be removed by cutting or grinding in the following steps (in a step S4), a thickness of the first connecting portion 56 is smaller than a thickness of the second connecting portion 57. Preferably, the thickness of the first connecting portion 56 is greater than or equal to 2 mm and smaller than or equal to 5 mm. However, the thickness of the first connecting portion 56 is not limited thereto, as long as it is large enough for processing machines to hold or magnetic tools to attract without damaging the block 50; and thus the thickness can be regulated according to specification of the magnetic element or the type of the processing machines and the magnetic tools. Afterwards, the process enters a step S2.

In the step S2, the block 50 is cut along a first plane P1 to divide the block 50 into a first half body 25 and a second half body 26. The first plane P1 passes through the central post 52 and the lateral posts 54 so that the first half body 25 includes the first connecting portion 56, and the second half body 26 includes the second connecting portion 57. In this embodiment, a diamond wire or a diamond wheel is used to cut the block 50 along the first plane P1 to divide the block 50 into the first half body 25 and the second half body 26. Afterwards, the process enters a step S3.

In the step S3, the first half body 25 and the second half body 26 are separated by a distance to form a first combination gap there between, and an adhesive is filled and sintered in the first combination gap to combine the first half body 25 and the second half body 26 and therefore forma first air gap GP1 between the central post 52 of the first half body 25 and the central post 52 of the second half body 26 and a second air gap GP2 between the lateral post 54 of the first half body 25 and the lateral post 54 of the second half body 26. The adhesive is a Bond-Ply material which has both stickiness and isolation properties and can be used to bond the first half body 25 and the second half body 26 and form the first air gap GP1 and the second air gap GP2. The Bond-Ply adhesive is hardened when it is sintered (heated and baked) so that the first air gap GP1 and the second air gap GP2 can be maintained in a predetermined width. Afterwards, the process enters a step S4.

In the step S4, the combined first half body 25 and the second half body 26 are cut or grinded along a second plane P2 to form a third half body 60. The second plane P2 passes through the central post 52 and the lateral posts 54. The third half body 60 includes the first air gap GP1 and the second air gap GP2. In this embodiment, the combined first half body 25 and the second half body 26 are cut or grinded by a diamond wire or a diamond wheel to form the third half body 60. In this embodiment, the first connecting portion 56 of the combined first half body 25 and second half body 26 is removed by cutting or grinding along the second plane P2 and so as to form the third half body 60. Afterwards, the process enters a step S5.

Figure 6A:
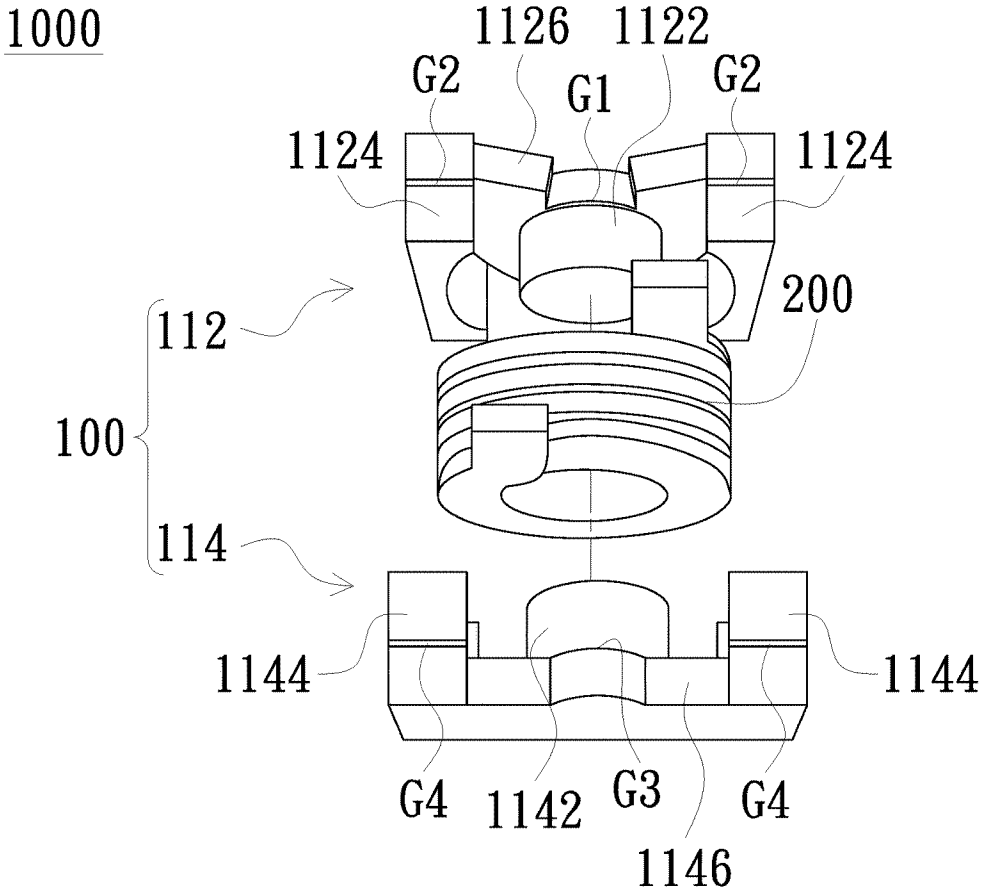
FIG. 6A is a perspective exploded view of an embodiment of a magnetic element of the present invention.

In the step S5, a winding 200 (as shown in FIG. 6A) is placed between two third half bodies 60 and around the central posts 52 of the two third half bodies 60. Afterwards, the process enters a step S6.

Figure 7A:
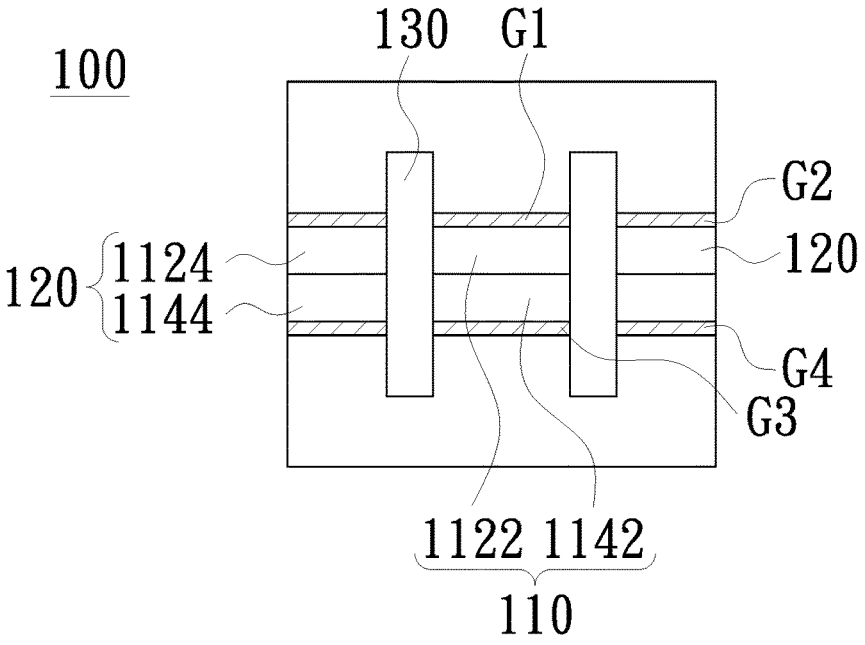
FIG. 7A is a cross section of an embodiment of a magnetic core member of FIG. 6A, which is obtained by the manufacturing method of FIGS. 2 and 3.

In the step S6, the two third half bodies 60 are combined, and they are combined in the same way as the first half body 25 combined with the second half body 26 so as to obtain a magnetic core member of FIG. 7A. The central post 52 has a first air gap GP1, and each of the lateral post 54 has two second air gaps GP2.

In the step S7, an isolating member is fixed to the lateral post 54 and separated from the lateral post 54 by a predetermined distance. The isolating member covers the second air gap GP2 to obtain the magnetic element 1000 of FIG. 6C. The isolating member is made of the same material as the magnetic core. The isolating member is disposed externally to the lateral post 54 and capable of conducting the magnetic flux leaked from the second air gap GP2 back to the isolating member, whereby the magnetic flux is isolated and thus converges through the isolating member so as to reduce eddy current loss caused by the leaked magnetic flux on a metal housing of a device or other metal elements and increase efficiency of the magnetic core member.

Figure 4:
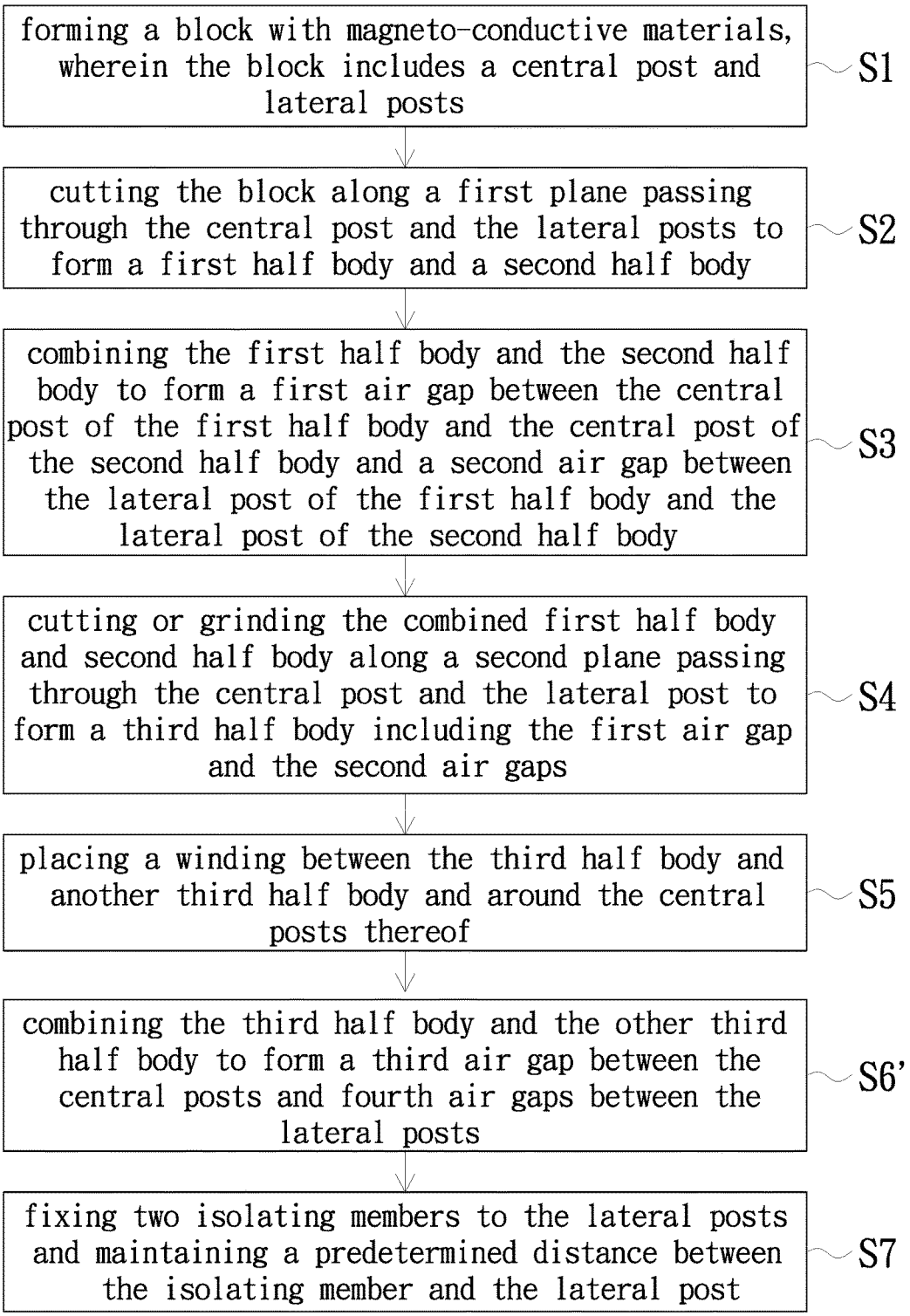
FIG. 4 is a flow chart of another embodiment of a manufacturing method of a magnetic element of the present invention.
Figure 5:
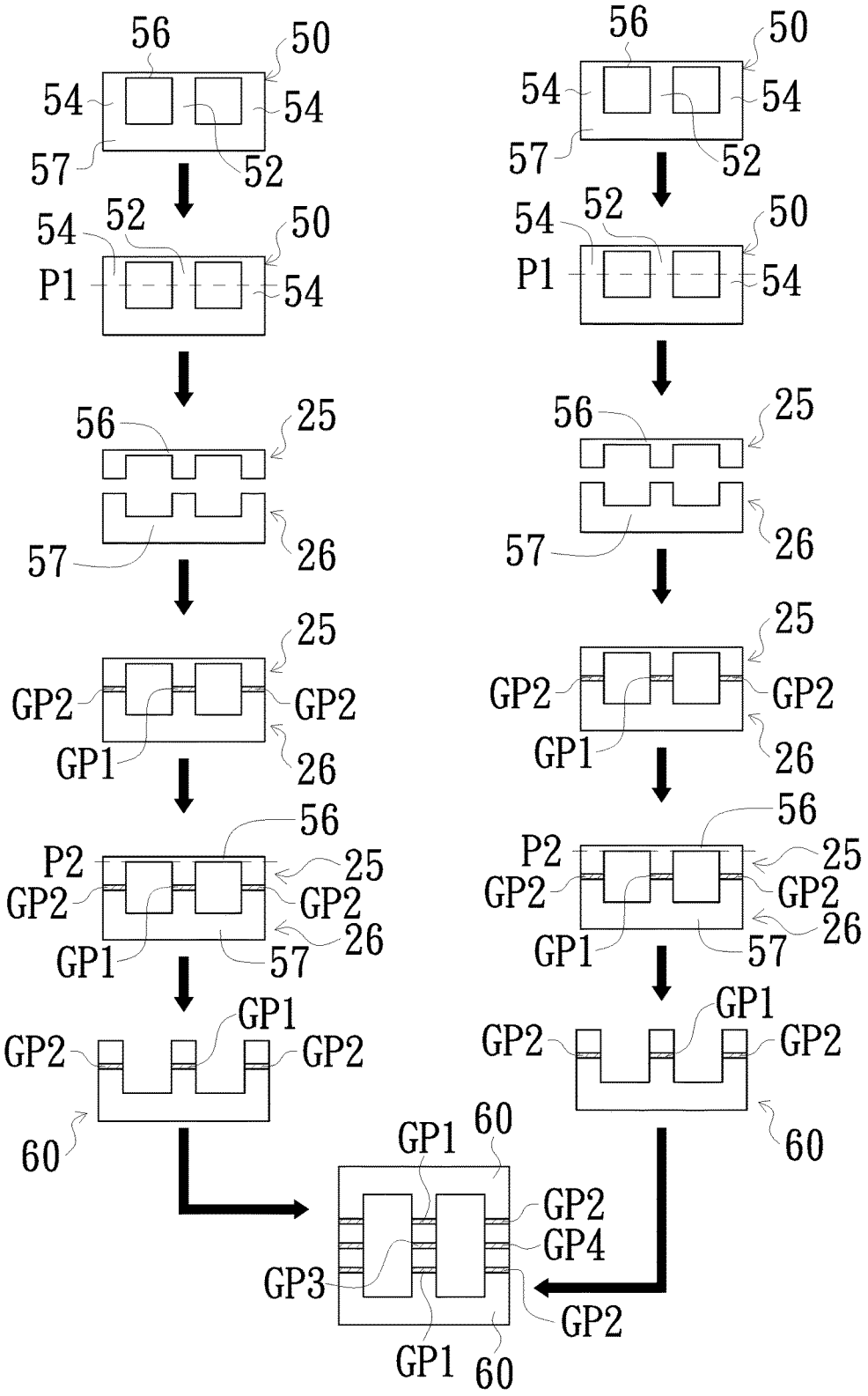
FIG. 5 is a schematic view of the manufacturing method of FIG. 4.
Figure 7B:
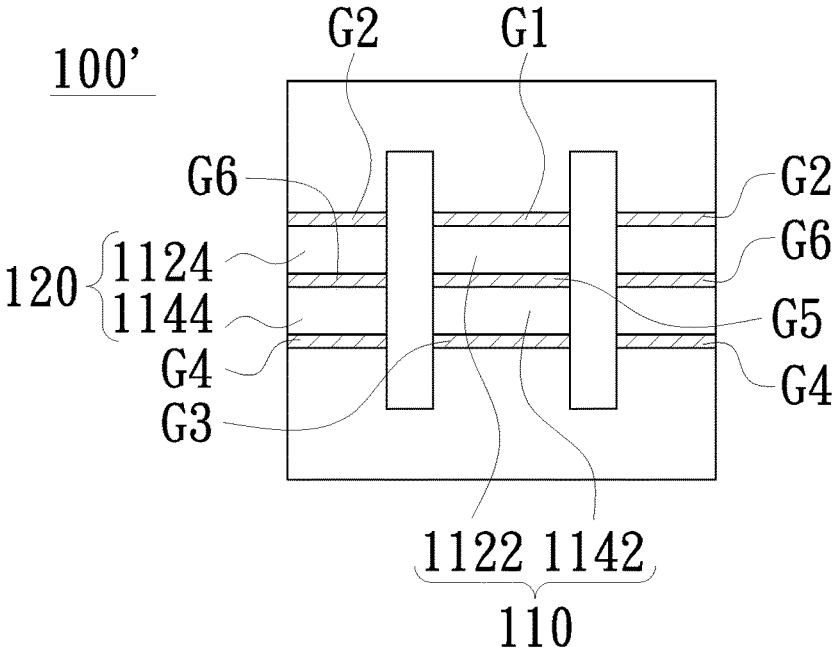
FIG. 7B is a cross section of another embodiment of a magnetic core member of the present invention, which is obtained by the manufacturing method of FIGS. 4 and 5.

FIGS. 4 and 5 show another embodiment of the manufacturing method of a magnetic element of the present invention. This embodiment differs from the embodiment of FIGS. 2 and 3 in a step S6'. In the step S6', when the two third half bodies 60 are combined to obtain a magnetic core member as shown in FIG. 7B, a gap is formed between two of the third half bodies 60 so that a third air gap GP3 is formed between the central post 52 of one of the third half body 60 and the central post 52 of the other third half body 60, and a fourth air gap GP4 is formed between the lateral post 54 of one of the third half body 60 and the lateral post 54 of the other third half body 60. The central post 52 has two first air gaps GP1 and one third air gap GP3, and the two lateral posts 54 have totally four second air gaps GP2 and two fourth air gaps GP4. Afterwards, the process enters a step S7. The step S7 of this embodiment is similar to the step S7 of the embodiment shown in FIGS. 2 and 3. However, the isolating member of this embodiment covers the second air gaps GP2 and the fourth air gaps GP4 to conduct the magnetic flux leaked from the second air gaps GP2 and the fourth air gaps GP4 back to the isolating member, whereby the magnetic flux is isolated and thus converges through the isolating member so as to reduce eddy current loss caused by the leaked magnetic flux on a metal housing of a device or other metal elements and increase efficiency of the magnetic core member.

Referring to FIG. 6A, a magnetic element 1000 manufactured through the manufacturing method of the present invention includes a magnetic core member 100 and a winding 200. The magnetic core member 100 includes a central post 110, two lateral posts 120 and a winding space 130. As shown in FIG. 6C, the winding 200 is disposed in the winding space 130 and around the central post 110. Two central air gaps G1 and G3 are formed in the central post 110, and two lateral air gaps G2 and G4 are formed in each of the lateral posts 120. The magnetic core member 100 is made of magneto-conductive materials.

As shown in FIG. 6A, in this embodiment, the magnetic core member 100 includes a first magnetic core 112 and a second magnetic core 114 connected to and aligned with the first magnetic core 111. The first magnetic core 112 and the second magnetic core 114 are the third half body 60 as mentioned above. The first magnetic core 112 includes a first central post 1122 and two first lateral posts 1124. The first central post 1122 is the central post 52 of the third half body 60, and the first lateral post 1124 is the lateral post 54 of the third half body 60. The first magnetic core 112 further includes a first connecting portion 1126 through which the first central post 1122 is connected to the first lateral posts 1124, whereby the first magnetic core 112 is thus W-shaped. The first connecting portion 1126 is the second connecting portion 57 of the third half body 60. The first lateral post 1124 has a cross sectional area that is half of a cross sectional area of the first central post 1122. The second magnetic core 114 includes a second central post 1142 corresponding to the first central post 1122 and two second lateral posts 1144 corresponding to the first lateral posts 1124. The second central post 1142 is the central post 52 of the third half body 60, and the second lateral post 1144 is the lateral post 54 of the third half body 60. The second magnetic core 114 further includes a second connecting portion 1146 through which the second central post 1142 is connected to the second lateral posts 1144, whereby the second magnetic core 114 is thus W-shaped. The second connecting portion 1146 is the second connecting portion 57 of the third half body 60. The second lateral post 1144 has a cross sectional area that is half of a cross sectional area of the second central post 1142.

Referring to FIG. 7A, the first magnetic core 112 is combined with the second magnetic core 114 face to face to form the magnetic core member 100 and the winding space 130 within the magnetic core member 100. The combination of the first magnetic core 112 and the second magnetic core 114 is accomplished by adhesives. Similarly, the first central post 1122 is combined with the second central post 1142 to form the central post 110. The two first lateral posts 1124 are combined to the two second lateral posts 1144 to from the two lateral posts 120. A first air gap G1 is formed in the first central post 1122, a second air gap G2 (a seventh air gap) is formed in the first lateral post 1124. A third air gap G3 is formed in the second central post 1142, and a fourth air gap G4 (an eighth air gap) is formed in the second lateral post 1144. The first air gap G1 and the third air gap G3 are the first air gap GP1 formed between two of the central posts 52, and the second air gap G2 and the fourth air gap G4 are the second air gap GP2 formed between two of the lateral posts 54. The central air gaps include the first air gap G1 formed in the first central post 1122 and the third air gap G3 formed in the second central post 1142. The lateral air gaps include the second air gaps G2 formed in the first lateral posts 1124 and the fourth air gaps G4 formed in the second lateral posts 1144. In this embodiment, an adhesive is filled and sintered in the first air gap G1, the second air gap G2, the third air gap G3 and the fourth air gap G4, and the adhesive is a Bond-Ply material. The Bond-Ply material has both stickiness and isolation properties and has a larger hardness after it is sintered (or heated) so as to form a predetermined air gap width. A position of the first air gap G1 corresponds to a position of the second air gap G2, and a position of the third air gap G3 corresponds to a position of the fourth air gap G4. In this embodiment, the position of the first air gap G1 is aligned with the position of the second air gap G2, and the position of the third air gap G3 is aligned with the position of the fourth air gap G4. Although the magnetic core member 100 is formed by the combination of the first magnetic core 112 and the second magnetic core 114, the magnetic core member 100 of the present invention is not limited thereto. In another embodiment, the magnetic core member of the present invention can be formed by combination of more than two magnetic cores.

Referring again to FIG. 6A, the winding 200 is directly disposed around the central post 110 and positioned in the winding space 130. In this embodiment, the winding 200 is formed by coils winded by flat wires having a width larger than its thickness. The winding 200 formed by such a flat wire has a DC resistance smaller than that of an ordinary winding formed by a wire having a width substantially equal to its thickness, such as a pie-shaped coil of multiple twisted lines, but has an AC resistance similar to that of ordinary winding. Therefore, the total loss in the winding 200 of flat wires is less than that in ordinary winding. When current flows in the winding 200, a magnetic field is created by the winding 200 due to electromagnetic effect. As the winding 200 is mounted to the central post 110 and the magnetic core member 100 is made of magneto-conductive materials, a magnetic flux generated by the winding 200 is conducted in the magnetic core member 100, forming a first magnetic path (not shown). The first magnetic path includes the first air gap G1, the two second air gaps G2, the third air gap G3 and the two fourth air gaps G4. Therefore, the first magnetic path includes two central air gaps (the first air gap G1 and the third air gap G3) and four lateral air gaps (the two second air gaps G2 and the two fourth air gaps G4). Since the cross sectional area of the central post 110 is twice the cross sectional area of the lateral post 120, the equivalent air gap of the first magnetic path is obtained by adding a product of the amount of the central air gap multiplied by a weighting coefficient 1 to a product of the amount of the lateral air gap multiplied by a weighting coefficient ½. That is the equivalent air gap of the first magnetic path is $2\times+4\times(1/2)=4$. The equivalent air gap of the first magnetic path is equivalent to four serially arranged central air gaps.

Figure 6B:
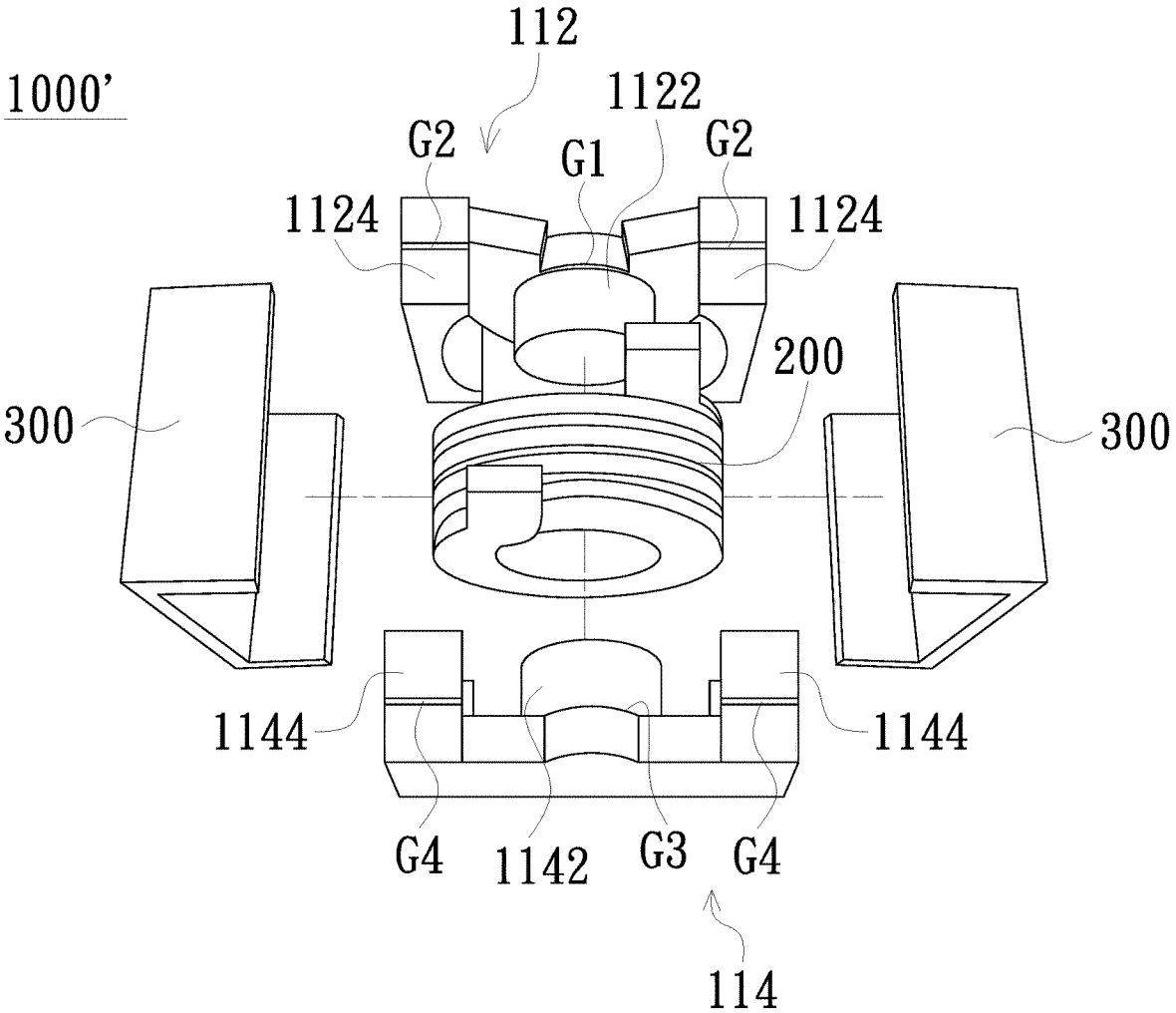
FIG. 6B is a perspective exploded view of another embodiment of a magnetic element of the present invention.
Figure 6C:
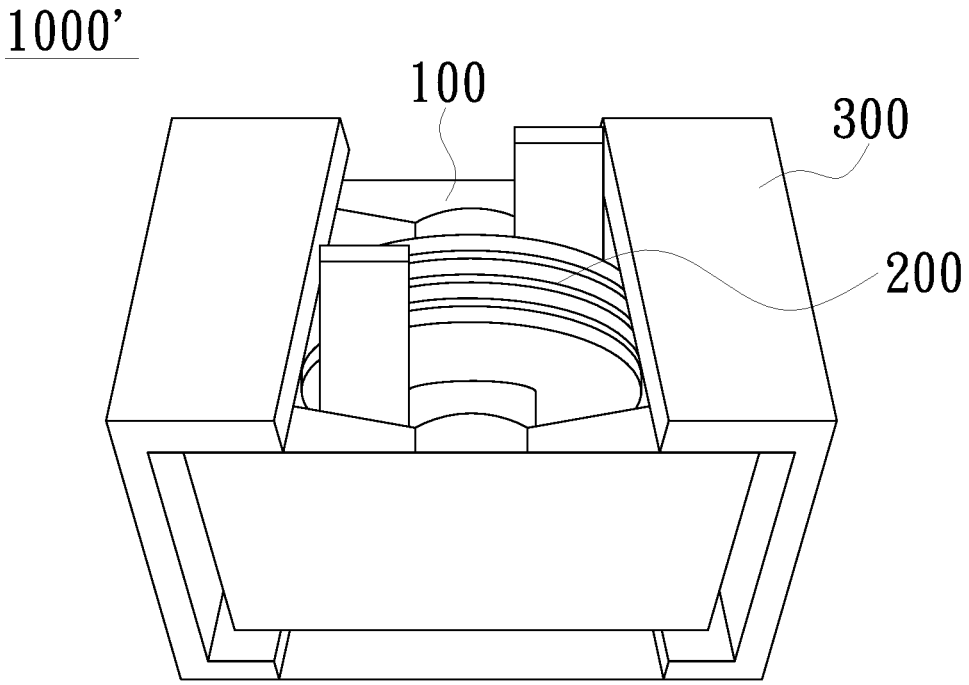
FIG. 6C is a perspective view of the magnetic element of FIG. 6B.

Referring to FIGS. 6B and 6C, another embodiment of a magnetic element of the present invention is disclosed. The magnetic element of this embodiment has a structure similar to that of the magnetic element shown in FIG. 6A. The same elements of the two embodiments are given the same numerical, and the descriptions for them are thus omitted. The magnetic element 1000' of this embodiment further includes an isolating member 300 disposed externally to the lateral post 120 and covers the lateral air gaps. The isolating member 300 is made of magneto-conductive materials. In this embodiment, the isolating member 300 is made of a material identical to that of the magnetic core member 100. The isolating member 300 is external to the lateral post 120 and the magnetic flux leaked from the lateral air gaps is conducted by the isolating member 300, whereby the magnetic flux is isolated and thus converges through the isolating member 300 so as to reduce eddy current loss caused by the leaked magnetic flux on a metal housing of a device or other metal elements and increase efficiency of the magnetic core member 100. The isolating member 300 of FIG. 6B is U-shaped covering a lateral side of the lateral post 120 as well as its front side and rear side so as to cover the lateral post 120 completely. In another embodiment, the isolating member 300 is C-shaped. In addition, since the isolating member 300 is made of magneto-conductive materials, the isolating member 300 is spaced from the lateral post 120 for a predetermined distance. If the isolating member 300 contacts the lateral post 120, the magnetic flux would flow directly through the isolating member 300 having a magnetic resistance less than the lateral post 120 rather than flowing through the lateral post 120.

Referring to FIG. 7B, a magnetic core member 100' manufactured by the manufacturing method of FIGS. 4 and 5 is shown. The magnetic core member 100' has a structure similar to the structure of the magnetic core member 100 of FIG. 7A. The same elements of the magnetic core members 100 and 100' are given the same numerical, and the descriptions for them are thus omitted. In this embodiment, the first magnetic core 112 is spaced from the second magnetic core 114 for a distance, whereby a fifth air gap G5 is formed between the first central post 1122 and the second central post 1142, and a sixth air gap G6 (ninth air gap) is formed between the first lateral post 1124 and the second lateral post 1144. The fifth air gap G5 is the third air gap GP3 formed between the central posts 52 of the two third half bodies 60 of FIG. 5, and the sixth air gap G6 is the fourth air gap GP4 formed between the central posts 52 of the two third half bodies 60 of FIG. 5. Similarly, an adhesive is also filled and sintered in the fifth air gap G5 and sixth air gap G6. The adhesive is a Bond-Ply material having both stickiness and isolation properties and having larger hardness after it is sintered (or heated) so as to form a predetermined air gap width. In this embodiment, a second magnetic path (not shown) is formed in the magnetic element 1000'. The second magnetic path includes the first air gap G1, the two second air gaps G2, the third air gap G3, the two fourth air gaps G4, the fifth air gap G5 and the two sixth air gaps G6. The second magnetic path includes three central air gaps (the first air gap G1, the third air gap G3 and the fifth air gap G5) and six lateral air gaps (two second air gaps G2, two fourth air gaps G4 and two sixth air gaps G6). The equivalent air gap of the second magnetic path is $3\times1+6\times(1/2)=6$. That is the equivalent air gap of the second magnetic path is equivalent to six serially arranged central air gaps.

In another embodiment, the magnetic core member 100 includes a first air gap G1 formed in the first central post 1122, a second air gap G2 formed in the second central post 1124, a fifth air gap G5 formed between the first central post 1122 and the second central post 1142 and two sixth air gaps G6 formed between the first lateral posts 1124 and the second lateral posts 1144. However, no air gap is formed in the second central post 1142 and the second lateral posts 1144. The magnetic core member 100 is manufactured through combination of a block 50 whose first connecting portion 56 is directly removed with a third half body 60, which already has a first air gap G1 in the central post and two second air gaps G2 in the lateral posts. When the block 50 is combined with the third half body 60, the fifth air gap G5 is formed between the central posts of the block 50 and the third half body 60, and the sixth air gap G6 is formed between the lateral posts of the block 50 and the third half body 60. The equivalent air gap of a magnetic path formed in the magnetic core member 100 is also equivalent to four serially arranged central air gaps similar to the calculation of the equivalent air gap for the embodiment of FIG. 6A.

The magnetic element 1000 and 1000' can be applied to a transformer of a fly back converter, an output inductance of a forward converter or an inductance element of a power factor correction circuit of a power supply to promote transfer efficiency of circuits.

Since the magnetic element of the present invention includes several air gaps formed in the central post and the lateral posts and distributed uniformly on the entire magnetic path, such a structure prevents magnetic saturation and controls the magnetic leakage loss in a desired range. In addition, the magnetic element of the present invention further includes the isolating member disposed externally to the lateral posts to conduct the leaked magnetic flux back to the isolating member so as to reduce magnetic leakage and loss. In addition, since the winding of the magnetic element of the present invention is directly disposed on the central post without a winding frame, the number of windings is thus increased so as to improve utilization ratio of the winding and working efficiency of the magnetic element.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A manufacturing method of a magnetic element, comprising:

(a) forming a block with magneto-conductive materials, wherein the block comprises a central post and two lateral posts;

(b) cutting the block along a first plane passing through the central post and the lateral posts to form and to be divided into a first body and a second body;

(c) after cutting the block, adhering the first body with the second body to form a first air gap between the central post of the first body and the central post of the second body and two second air gaps between the lateral posts of the first body and the lateral posts of the second body; and (d) cutting and grinding the adhered first body and second body along a second plane passing through the central post and the lateral posts to form a third body comprising the first air gap and the second air gaps.

2. The manufacturing method according to claim 1, wherein the block comprises a first connecting portion connecting the central post and the lateral posts and a second connecting portion connecting the central post and the lateral posts, the first body comprises the first connecting portion, and the second body comprises the second connecting portion.

3. The manufacturing method according to claim 2, wherein the step (d) further comprises:

removing the first connecting portion of the first body.

4. The manufacturing method according to claim 3, wherein a thickness of the first connecting portion is smaller than a thickness of the second connecting portion.

5. The manufacturing method according to claim 4, wherein the thickness of the first connecting portion is greater than or equal to 2 mm and smaller than or equal to 5 mm.

6. The manufacturing method according to claim 1, wherein the step (c) further comprises:

forming a first combination gap between the first body and the second body; and filling and sintering an adhesive in the first combination gap.

7. The manufacturing method according to claim 6, wherein the adhesive is a thermal sintered material.

8. The manufacturing method according to claim 1, further comprising:

making another third body by doing the steps (a) to (d);

placing a winding around the central post of the third body; and combining the third body and the another third body in a manner of central post-to-central post and lateral posts-to-lateral posts.

9. The manufacturing method according to claim 8, wherein the step of combining the third body and the another third body further comprises:

forming a second combination gap between the third body and the another third body;

forming a third air gap between the central post of the third body and the central post of the another third body; and forming two fourth air gaps between the lateral posts of the third body and the lateral posts of the another third body.

10. The manufacturing method according to claim 8, wherein the winding comprises coils winded by electro-conductive flat wires.

11. The manufacturing method according to claim 1, further comprising:

fixing an isolating member to the lateral posts and maintaining a predetermined distance between the isolating member and the lateral posts.

12. The manufacturing method according to claim 11, wherein the isolating member is comprised of magneto-conductive materials.

13. The manufacturing method according to claim 11, wherein the isolating member covers the second air gaps completely.

14. The manufacturing method according to claim 1, wherein the block is formed by sintering magneto-conductive metal powder.

15. The manufacturing method according to claim 14, wherein the magneto-conductive metal powder comprises manganese-zinc alloy powder.

16. The manufacturing method according to claim 1, wherein the block is cut by a diamond wire or a diamond wheel along the first plane to form the first body and the second body.

17. The manufacturing method according to claim 1, wherein the adhered first body and second body are cut by a diamond wire or a diamond wheel along the second plane to form the third body.

* * * * *